US005434039A

United States Patent [19]

Nagata et al.

[11] Patent Number: 5,434,039

[45] Date of Patent: Jul. 18, 1995

[54] SUPPORT MEMBER FOR PHOTOGRAPHIC PRINTING PAPER AND METHOD FOR MANUFACTURING THE SAME

[75] Inventors: Kozo Nagata; Yasuhiro Ogata; Tetsuro Fuchizawa, all of Fujinomiya, Japan

[73] Assignee: Fuji Photo Film Co., Ltd., Kanagawa, Japan

[21] Appl. No.: 281,680

[22] Filed: Jul. 28, 1994

Related U.S. Application Data

[63] Continuation of Ser. No. 55,361, May 3, 1993, abandoned.

[30] Foreign Application Priority Data

May 7, 1992 [JP] Japan ..... 4-114587

[51] Int. Cl.[6] ..... G03C 1/76

[52] U.S. Cl. ..... 430/531; 430/538; 430/533; 430/536; 430/523; 430/935; 428/331

[58] Field of Search ..... 430/538, 533, 536, 531, 430/523, 935; 428/331

[56] References Cited

U.S. PATENT DOCUMENTS 4,610,924 9/1986 Tamagawa et al. ..... 450/538

OTHER PUBLICATIONS

J. A. Seiner and H. L. Gerhart, "Light Scattering from Microvoids. Applications to Polymer Coatings", Ind. Eng. Chem. Prod. Res. Develop., vol. 12, No. 2, 1973.

*Primary Examiner*—Thomas R. Neville
*Attorney, Agent, or Firm*—Sughrue, Mion, Zinn, Macpeak & Seas

[57] ABSTRACT

The support member for photographic printing paper of the present invention has a coating layer which comprises white pigment and hydrophobic binder soluble in an organic solvent on a base material, whereby voids are formed in said coating layer. The support member increases whiteness degree and gives an image with excellent sharpness.

2 Claims, No Drawings

SUPPORT MEMBER FOR PHOTOGRAPHIC PRINTING PAPER AND METHOD FOR MANUFACTURING THE SAME

This is a Continuation of application Ser. No. 08/055,361 filed May 3, 1993, now abandoned.

BACKGROUND OF THE INVENTION

The present invention relates to a support member for photographic printing paper to give excellent image, and in particular to a support member for photographic printing paper to increase whiteness degree and to provide excellent sharpness.

In recent years, a support member for waterproof photographic printing paper has been used, both sides of which are coated with polyolefin such as polyethylene for rapid development processing of photographic printing paper. However, photographic image obtained from the photographic printing paper using polyolefin-coated paper is disadvantageous in that resolving power is not very high.

The reason for this may be as follows: In a polyolefin-covered support member, white pigment is mixed in polyolefin layer of the surface which contacts photosensitive silver halide emulsion, while the quantity of white pigment thus mixed is so small and shielding effect is not sufficient that light scatters within the polyolefin layer.

Normally, titanium oxide is used as the white pigment. Improvements of surface coating of titanium oxide to increase the quantity filled into polyolefin have been disclosed in Japanese Patent Laid-Open Publication No. 55-108658 and Japanese Patent Laid-Open Publication No. 57-35855, etc., and simultaneous use with other pigment is disclosed in Japanese Patent Publication No. 49-27046. In any case, however, filling quantity of titanium oxide is up to 15 weight % at the highest.

In this respect, methods are described in Japanese Patent Publication No. 57-53937 and Japanese Patent Laid-Open Publication No. 57-64235, by which a white pigment layer comprising white pigment and hydrophilic colloid solution is placed on a film or a resin-coated paper, and a photosensitive emulsion layer is placed on the white pigment layer. In the photographic printing paper using the support member disclosed in these patents, binder of the white pigment layer is hydrophilic and absorbs development processing solution or water, and it is disadvantageous because drying is delayed compared with the photographic printing paper using ordinary polyolefin-coated paper as the support member.

A method to coat an aqueous emulsion comprising binding agent and pigment is disclosed in Japanese Patent Laid-Open Publication No. 50-44818. However, when aqueous material is coated, drying is delayed and high-speed processing is not achievable, or drying zone must be extremely enlarged. Further, when emulsion is used, mechanical stability of the emulsion is reduced and uniform coating is not accomplished when gravure roll or bar are coated continuously.

To overcome the above problems, Japanese Patent Laid-Open Publication No. 59-200234 discloses a method, by which a binder soluble in organic solvent and white pigment are coated. By these methods, it is possible to increase filling ratio of white pigment in the binder, to raise masking power of the pigment layer of the support member, and to increase sharpness of photographic image. Masking power of pigment layer exerts strong influence on sharpness of photographic image and it is determined almost completely by white pigment. Thus, there is a limit in the sharpness of the photographic image obtained.

It is an object of the present invention to provide a support member for photographic printing paper to increase whiteness degree and to give photographic image with higher sharpness.

SUMMARY OF THE INVENTION

To attain the above object, a support member for photographic printing paper of the present invention comprises a coating layer, which contains white pigment and hydrophobic binder soluble in organic solvent on a base material, and there are provided voids in said coating layer.

Also, the support member for photographic printing paper of the present invention can be produced as follows: White pigment and hydrophobic binder are contained as principal components, and said binder is dissolved in an organic solvent capable of dissolving the binder, and a solvent substantially not dissolving the binder is added to prepare a coating solution. This coating solution is coated on a base material. Then, the coating layer is dried and voids are formed in the coating layer.

In the support member for photographic printing paper of the present invention, voids are formed in the coating layer, which comprises white pigment and hydrophobic binder on the base material. In so doing, it is possible to provide a support member for photographic printing paper to increase masking power, to raise whiteness degree and to give an image with higher sharpness, although detailed reason is not known.

DESCRIPTION OF THE PREFERRED EMBODIMENTS

In the following, detailed description will be given on the present invention.

As white pigment used in the present invention, titanium dioxide, barium sulfate, calcium sulfate, barium carbonate, calcium carbonate, lithopone, alumina white, zinc oxide, silica white, antimony trioxide, titanium phosphate, etc. may be used. In particular, it is preferable to use titanium dioxide because masking power is high. As titanium dioxide, rutile type or anatase type may be used, or it may be produced by sulfuric acid method or chlorine method. As titanium oxide, it is preferable to use the one processed by inorganic surface treatment such as alumina hydrate treatment and/or silicon dioxide hydrate treatment or by organic coating treatment such as trimethylolmethane, trimethylolethane, trimethylolpropane, 2,4-dihydroxy-2-methylpentane, etc. or the one processed by surface treatment with surface active agent.

Among these substances, it is preferable to use the one processed by inorganic surface treatment such as alumina hydrate treatment and/or silicon dioxide hydrate treatment because less discoloring occurs due to long-term use or by heat. When titanium dioxide is primarily used, other pigment may be used at the same time. For example, in the ratio of titanium dioxide to other pigment, it is preferable to use titanium dioxide by 50 weight % or more, or more preferably by 70 weight % or more, or still more preferably by 90 weight % or more. It is most preferable to use titanium dioxide alone.

As the binder to be used in the present invention, any binder may be used if it is soluble in organic solvent. These are, for example, homopolymer, copolymer or terpolymer such as polyamide resin, polyester resin, polyvinyl resin, polyurethane resin, melamine resin, urea resin, alkyd resin, acryl resin, phenol resin and cellulose resin, or blended product of these substances. It is preferable to use polyvinyl chloride and vinyl chloride-vinyl acetate copolymer, polyvinyl acetate, polystyrene, etc., or more preferably, vinyl chloride-vinyl acetate-maleic acid anhydride copolymer, vinyl chloride-vinylidene chloride-vinyl acetate-maleic acid anhydride copolymer, etc.

In the white pigment layer, various types of photographic additives such as organic dye or inorganic pigment, fluorescent brightener, cross-linking agent, antifoggant, stabilizer or anti-coloring agent in development process such as tetrazaidenes or tetrazoles, etc. may be added.

Voids in the present invention are defined as spaces filled by gas in white pigment coating layer. In general, it is known that voids can be efficiently generated in coating film not containing pigment (J. A. Seiner and H. L. Gerhart et al.: Ind. Eng. Chem. Prod. Res. Develop, Vol 1, No. 2, 1973). They report that, when a coating solution containing a binder, an organic affinity solvent dissolving the binder and a non-solvent virtually not dissolving the binder is coated on a base material and dried, it is possible to prepare a white coating film containing voids.

After fervent efforts, the present inventors have found that, when voids are generated by the above method in a coating layer containing white pigment and it is used as a support member for photographic printing paper, the image on the photographic paper has very high sharpness.

The organic solvent to dissolve hydrophobic binder (also called affinity solvent) in the present invention is an organic solvent to completely dissolve hydrophobic binder, and it is preferable to use a solvent with low toxicity. For example, when vinyl chloride-vinylidene chloride-vinyl acetate-maleic acid anhydride copolymer is used as the binder, it is preferable to use, for example, acetone, methylethylketone, ethyl acetate, toluene, butyl acetate, methylisobutylketone, etc. are more preferably used, and a mixture of these substances may be used.

The solvent virtually not dissolving hydrophobic binder (also called "non-solvent") in the present invention is a solvent, which virtually does not dissolve binder. It is preferable that it has low toxicity. For example, when the above binder is used, alcohols such as methyl alcohol, ethyl alcohol, isopropanol, n-propanol, 2-ethylbutanol, tert-butanol, sec-butanol, n-butanol, n-hexanol, n-heptyl alcohol, n-amyl alcohol, iso-amyl alcohol, cyclohexanol, benzyl alcohol, furfuryl alcohol, etc. may be used or carbitol, glycerine, ethylene glycol, water, etc. may be used. Or, two or more of these substances may be mixed and used.

The ratio of non-solvent in the coating solution can be determined as desired. In view of voids generating efficiency, when the ratio of binder solids to affinity solvent is 100/300, the ratio of non-solvent to the binder is preferably 30 weight % or more, or more preferably 60 weight % or more, or most preferably 90 weight % or more.

When white pigment is dispersed in binder, it is possible to use dispersion aid such as surface active agent if necessary. Further, desirable fine dispersion substances can be obtained if various type of dispersion equipment is used (e.g. homomixer, homogenizer, ball mill, colloid mill, dyna-mill, sand mill, etc.).

In the present invention, it is preferable to add white pigment by about 20 weight % to the binder, or more preferably 30–80 weight %. Coating quantity of white pigment is about 0.1–20 g per square meter.

If coating quantity of white pigment is 0.1 $g/m^2$ or less, masking power is too low, and photographic image with resolving power cannot be obtained. When coating quantity of white pigment is 20 $g/m^2$ or more, resolving power remains the same, and this is useless in terms of cost.

After the coating solution is coated on the base material in the present invention, drying temperature can be chosen as desired to generate voids. It is preferably 100° C. or less, or more preferably 75° C. or less, and most preferably 50° C. or less.

The coating solution of the present invention can be coated by any of the known coating methods such as dip coating method, air knife coating method, curtain coating method, roller coating method, doctor coating method, wire bar coating method, slide coating method, gravure coating method, or extrusion coating method using a hopper described in the specification of U.S. Pat. No. 2,681,294.

As the base material to be used in the present invention, paper coated with resin such as polyethylene, polypropylene, etc., synthetic macromolecular film such as polyethylene film, polypropylene film, polystyrene, polyethylene terephthalate, polycarbonate, hard vinyl chloride, etc., or natural macromolecular film such as cellulose diacetate, cellulose triacetate, nitrocellulose, etc., or paper made of natural pulp, synthetic pulp, etc. may be used. These base materials may be processed by pre-treatment to increase adhesive property with the binder layer containing white pigment. As the pre-treatment methods, there are a method to immerse in oxidizing solution, flame treatment, corona discharge treatment, glow discharge treatment, or activation treatment such as ultraviolet irradiation method. It is preferable to use corona discharge treatment because it is simple and economical. Further, to provide firm bonding, an undercoating layer of gelatin including hardening agent may be coated after corona discharge treatment.

In silver halide photographic layer advantageously used in the execution of the present invention, various types of silver halide emulsion may be used. For example, as silver halide composition, emulsion of silver chloride, silver bromide, silver chlorobromide, silver chloroiodobromide, silver iodochloride, silver iodobromide, etc. or emulsion made of mixture of these substances may be properly used for each intended purpose. Negative type silver halide photographic emulsion may be used, or if necessary, positive type silver halide photographic emulsion may be directly used. Photographic layer may be provided immediately adjacent to white pigment layer, and gelatin undercoating layer may be provided, and photographic layer may be placed on it.

When photographic layer or undercoating layer are provided directly adjacent to the white pigment layer, surface treatment may be performed on the surface of the white pigment layer by corona treatment.

In the following, description will be given on the present invention in connection with several examples.

(Example 1)

A mixture was prepared, which contains 100 weight parts of hydrophobic binder (solids), i.e. quarternary copolymer compound, which comprises 10 weight parts of vinylidene chloride, 70 weight parts of vinyl chloride, 15 weight parts of vinyl acetate, and 5 weight parts of maleic acid anhydride, as well as 100 weight parts of anatase type titanium oxide with surface treatment by alumina and silicon dioxide, and 300 weight parts of ethyl acetate, which is an organic affinity solvent of the above binder. The mixture was dispersed by a planetary type ball mill to prepare resin solution containing white pigment.

To this solution, 100 weight parts of a non-solvent, i.e. n-propanol, was added. This was coated on the polyethylene-coated paper described in the comparative example 1 as given below so that coating quantity of titanium oxide after drying is 10 g/m$^2$.

(Example 2)

A sample was prepared by the same procedure as in Example 1, except that futile type titanium oxide with surface treatment by alumina and silicon dioxide was used instead of anatase type titanium oxide.

(Example 3)

A sample was prepared by the same procedure as in Example 2, except that n-butanol was used instead of n-propanol.

(Example 4)

A sample was prepared by the same procedure as in Example 2, except that the weight ratio of the binder solids and titanium dioxide was 1:5.

(Example 5)

A sample was prepared by the same procedure as in Example 2, except that coating quantity of titanium oxide was 2 g/m$^2$.

(Comparative Example)

To prepare polyethylene-coated paper, both sides of original paper were coated with polyethylene, and corona discharge treatment was performed on the side where photographic emulsion is to be coated, and a gelatin undercoating layer was provided. Of the above polyethylene-coated layer, the polyethylene layer where photographic emulsion is to be coated was prepared in such manner that it contained anatase type titanium oxide by 10 weight % to polyethylene and total quantity of titanium oxide was 4.0 g/m$^2$ and that the polyethylene layer had thickness of 30 μm.

(Comparative Example 2)

A sample was prepared by the same procedure as in Example 1, except that ethyl acetate was added by additional 100 weight parts instead of n-propanol.

(Comparative Example 3)

A sample was prepared by the same procedure as in the comparative example 2, except coating quantity of titanium oxide was 2 g/m$^2$.

[Test methods]

(1) Sharpness

Emulsion for color photographic printing paper was coated on each of the above support members, and the photographic printing paper was prepared. On the photographic printing paper thus prepared, resolving power test charts were printed by blue exposure, green exposure and red exposure, and these were processed for developing, fixing and washing. Then, densities of yellow image, magenta image and cyan image were measured by microphotometer. Sharpness is obtained by the following equation, and results are given in Table 1.

$$\text{Sharpness (\%)} = \frac{\text{(Max. density} - \text{min. density) of 10 lines/mm thin line print image}}{\text{(Max. density} - \text{min. density) in large area portion}} \times 100$$

The higher this value is, the better sharpness the image has.

(2) Whiteness degree

Whiteness degree was evaluated by diffusion reflectivity (of light with wavelength 440 nm) of a support member, using Hitachi Model 607 color analyzer.

TABLE 1

| | Components of solution coated on PE-coated paper | | | | | Sharpness | | | |
|---|---|---|---|---|---|---|---|---|---|
| | Non-solvent | Titanium oxide | Binder/pigment ratio | Coating q'ty of titanium oxide | Voids | Blue sensitive layer | Green sensitive layer | Red sensitive layer | Whiteness degree |
| Example 1 | n-propanol | Anatase type | 1/1 | 10 g/m$^2$ | Present | 85 | 88 | 85 | 88.5 |
| Example 2 | n-propanol | Rutile type | 1/1 | 10 g/m$^2$ | Present | 86 | 90 | 87 | 89.5 |
| Example 3 | n-butanol | Rutile type | 1/1 | 10 g/m$^2$ | Present | 88 | 92 | 88 | 91.0 |
| Example 4 | n-propanol | Rutile type | 1/5 | 10 g/m$^2$ | Present | 80 | 84 | 81 | 87.0 |
| Example 5 | n-propanol | Rutile type | 1/1 | 2 g/m$^2$ | Present | 76 | 79 | 76 | 86.0 |
| Comparative example 1 | — | — | — | — | — | 66 | 70 | 67 | 83.3 |
| Comparative example 2 | — | Rutile type | 1/1 | 10 g/m$^2$ | None | 73 | 76 | 74 | 84.5 |
| Comparative example 3 | — | Rutile type | 1/1 | 2 g/m$^2$ | None | 69 | 73 | 70 | 83.5 |

As it is evident from the table, the support member for photographic printing paper of the present invention increases whiteness degree and provides an image with higher sharpness.

What we claim is:

1. A method for manufacturing a silver halide emulsion-containing photographic printing material, said method comprising preparing a coating solution by dissolving hydrophobic binder in an organic solvent capable of dissolving the hydrophobic binder, dispersing titanium dioxide, and after said hydrophobic binder is dissolved in the organic solvent capable of dissolving the hydrophobic binder, adding a solvent substantially not capable of dissolving said hydrophobic binder, coating said coating solution on a base material to form a coating layer, then drying said coating layer to form voids in the coating layer, then coating silver halide emulsion on said coating layer to form a silver halide emulsion layer, then drying said silver halide emulsion layer, wherein the titanium dioxide is present in an amount of 0.1 to 20 g per square meter of the material.

2. A method for manufacturing a silver halide emulsion-containing photographic printing material as in claim 1, wherein the solvent substantially not capable of dissolving the binder is an alcohol.

* * * * *